US005669943A

United States Patent [19]

Horton et al.

[11] Patent Number: 5,669,943

[45] Date of Patent: Sep. 23, 1997

[54] CUTTING TOOLS HAVING TEXTURED CUTTING SURFACE

[75] Inventors: M. Duane Horton, Provo, Utah; Marcus R. Skeem, Northbridge, Mass.; Paul K. Huber, Salt Lake City, Utah

[73] Assignee: Norton Company, Worcester, Mass.

[21] Appl. No.: 749,045

[22] Filed: Nov. 14, 1996

Related U.S. Application Data

[63] Continuation of Ser. No. 476,160, Jun. 7, 1995, abandoned.

[51] Int. Cl.[6] ..... B24D 11/00

[52] U.S. Cl. ..... 51/307; 51/309; 451/547

[58] Field of Search ..... 51/295, 307, 309; 428/143, 161, 168; 451/547

[56] References Cited

U.S. PATENT DOCUMENTS

| | | | |
|---|---|---|---|
| 3,863,401 | 2/1975 | Schwarzkopf et al. | 51/206.4 |
| 4,037,367 | 7/1977 | Kruse | 451/551 |
| 4,047,902 | 9/1977 | Wiand | 51/295 |
| 4,275,528 | 6/1981 | Higginbotham | 451/547 |
| 4,317,660 | 3/1982 | Kramis et al. | 51/295 |
| 4,592,433 | 6/1986 | Dennis | 175/428 |
| 4,624,237 | 11/1986 | Inoue | 451/450 |
| 4,908,026 | 3/1990 | Wiand | 51/293 |
| 4,925,457 | 5/1990 | deKok | 51/293 |
| 5,011,511 | 4/1991 | Beck | 51/295 |
| 5,203,881 | 4/1993 | Wiand | 51/293 |
| 5,453,106 | 9/1995 | Roberts | 51/307 |

FOREIGN PATENT DOCUMENTS

| | | | |
|---|---|---|---|
| 528083 | 4/1954 | Belgium . | |
| 3918606A1 | 2/1990 | Germany | B24D 3/08 |
| 4336970 | 11/1992 | Japan | B24D 3/06 |
| 2197335A | 5/1988 | United Kingdom | B24D 3/06 |
| 91/16175 | 10/1991 | WIPO | B24D 3/00 |

*Primary Examiner*—Deborah Jones
*Attorney, Agent, or Firm*—Mary E. Porter

[57] ABSTRACT

Textured indentations in the cutting surface of the core of a cutting tool are designed to accommodate a single layer of superabrasive grain. The superabrasive grain contained in these textured indentations is thereby oriented during metal bond brazing such that a cutting edge of the superabrasive grain is oriented outward from the plane of the cutting surface of the core. Enhanced bond life, cutting performance and tool life are achieved.

15 Claims, 1 Drawing Sheet

CUTTING TOOLS HAVING TEXTURED CUTTING SURFACE

This application is a continuation of application Ser. No. 08/476,160, filed Jun. 7, 1995, now abandoned.

BACKGROUND

Single layer metal bonded superabrasives are used to form the cutting surfaces of various cutting tools such as core drill bits, diamond saw blades and metal single layer grinding wheels. These cutting tools are useful for cutting and abrading extremely hard materials such as concrete, stone, ceramics and the like, as well as for drilling subterranean formations in oil and gas recovery. Such cutting tools are normally constructed from a core or blade support material such as steel or aluminum, a superabrasive such as diamond or cubic boron nitride (CBN) and a brazing material, typically a metal braze, which adheres the superabrasive to the core or blade support. The abrasive is bonded to the support at one or more cutting surfaces.

Several variations have been proposed and used in the manufacture of cutting tools to enhance the cutting performance and tool life of metal bonded superabrasive products. For example, radial, parallel or spiral grooves have been etched into the core or support portion of the tool so as to assist in the removal of debris during the cutting operation and to enhance the passage of cooling lubricant to the site being cut, so as to reduce thermal stress and wear on the cutting tool. These grooves may also extend through the diamond or abrasive segments of the cutting tool. U.S. Pat. No. A-4,624,237 to Inoue, et al, discloses one such construction for a diamond saw blade. U.S. Pat. No. A-4,037,367 to Kruse discloses a similar construction for a grinding tool.

U.S. Pat. No. A-4,908,046 to Wiand discloses another such construction, wherein multiple abrasive grains are contained within each groove in a plurality of grooves on the cutting surface.

U.S. Pat. No. A-4,275,528 to Higginbotham discloses helical grooves particularly useful in core drill bits, wherein one or both surfaces of the helical grooves are lined with multiple diamond grains. These grooves assist in removal of debris and in providing cooling lubricant access to the work piece during cutting.

U.S. Pat. No. A-4,592,433 to Dennis discloses rounded grooves in the cutting surfaces of core drill bits, wherein the rounded grooves are filled with strips of a diamond substance in a carrier matrix. This construction is suggested as a more secure means for adhering the diamond matrix to the cutting substrate.

In each instance, the cutting surface of the tool is scored to a depth sufficient to permit multiple diamond particles or grains or a diamond containing matrix to be adhered to each groove of the cutting surface indentations. In many instances the texture is provided to the cutting surface for the purpose of removal of cutting debris and flow of fluid lubricant to the workpiece. Thus, textured cutting surface tools known in the art have not been designed to maximize the utility of individual superabrasive grains, the single most expensive component of the cutting tool.

Furthermore, while metal brazing of a single layer of diamond has proven to be an effective means of constructing cutting tools, the brazing process permits individual diamond grains to float in the hot, liquid metal braze, thus frustrating attempts to orient the flat planes of the surface of diamond grains in a direction perpendicular to the cutting surface of the tool, and thereby expose sharp corners of the grain to the work piece. Surface tension creates meniscus forces during brazing which draw the diamond grain to the surface of the tool so that a flat face is parallel to the tool surface. As a result, the opposite flat face of the diamond, representing the cutting point of the grain, is also parallel with the surface of the tool. During cutting, a new abrasive grain situated in this manner acts the same way as a worn grain which has developed a flat surface from wear. Thus, a brand new grain of diamond or other superabrasive cuts as if it is a worn grain. In a similar fashion, the meniscus forces tend to draw adjacent grains of abrasive together and, thereby, cause clustering which is random and uncontrollable. Finally, as with most abrasive tools, the bond holding the abrasive grain to the support matrix is the weakest component of the construction, and the life of the abrasive tool is significantly enhanced when the bond between the abrasive grain and the support is strengthened.

By providing indentations forming a texture on the cutting surface such that the position of individual superabrasive grains may be controlled during metal brazing, a cutting tool having superior cutting performance and tool life may be manufactured. The textured indentations are provided on a scale suitable for containing single grains of abrasive in a single layer, such that abrasive clustering and areas of the cutting surface devoid of abrasive do not occur. While the meniscus forces still draw the individual grains to the surface such that the flat face of the surface is parallel to the adjacent surface, the portion of the cutting surface on which the abrasive grain adheres is the substantially vertical side of an indentation on the cutting surface. In this manner the abrasive grain is oriented with a point or cutting edge, rather than a flat surface, exposed to the workpiece during operation.

By selecting from a variety of surface treatments, the texture may be formed by individual holes or slots in the surface, or by microgrooves configured in parallel, radial, spiral or cross-hatch patterns. To provide maximum cutting effectiveness, the texturing has dimensions which are approximately the same as, or less than the dimensions of the abrasive grains. Finally, because the texture is part of the cutting surface of the metal core of the tool, the texture is typically made of steel or a material which is stronger than the typical metal braze, and, therefore, provide additional support to the bond during cutting operations. This additional support creates longer tool life.

SUMMARY OF THE INVENTION

This invention provides an abrasive tool comprising a metal core, superabrasive grain and a metal bond between the superabrasive grain and the metal core, which metal bond is formed by brazing, wherein the metal core has at least one cutting surface with textured indentations, the textured indentations being sized to contain a single layer of individual abrasive grains.

The textured indentations may be in the form of microgrooves, cross-hatches, slots, holes or other cutting surface indentations. The superabrasive grain includes diamond, synthetic diamond or cubic boron nitride. The abrasive tools include diamond core drill bits, diamond saw blades, and metal single layer grinding wheels, and any other cutting or abrading tool wherein the abrasive is present in a single layer which is bonded to the tool by a metal braze.

The textured indentations typically have a V-shape in cross section, have a depth less than, or approximately equal to the average diameter of the superabrasive grains, and provide an angle of opening of at least 60°, preferably 120°, and no more than 160°, to accept and orient individual superabrasive grains.

The superabrasive grain is preferably uniform in size and morphology.

DESCRIPTION OF THE PREFERRED EMBODIMENT

Figure 1:
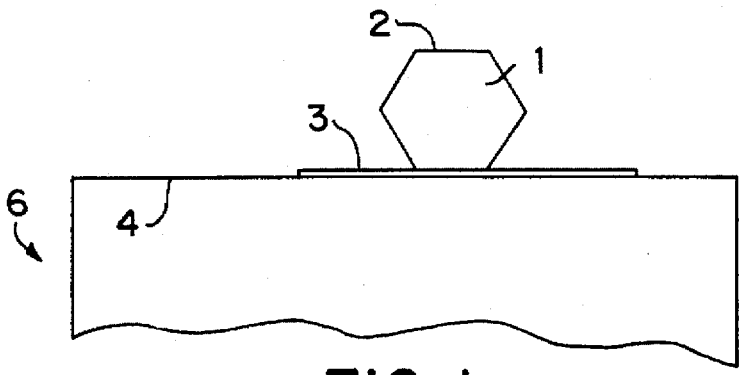
FIG. 1 is a cross-sectional view of the metal brazed single layer abrasive tool cutting surface of the prior art.

With reference to the figures, the prior art metal single layer brazed superabrasive is illustrated by FIG. 1. The diamond grain (1) is adhered to the cutting surface (4) by a metal bond (3) which during brazing has drawn a flat surface of the diamond grain to the flat surface of the cutting surface (4) of the core (6). Thus, the diamond facet (2) exposed to the workpiece during cutting is a flat surface and not a pointed, sharp surface suitable for efficient cutting.

Figure 2:
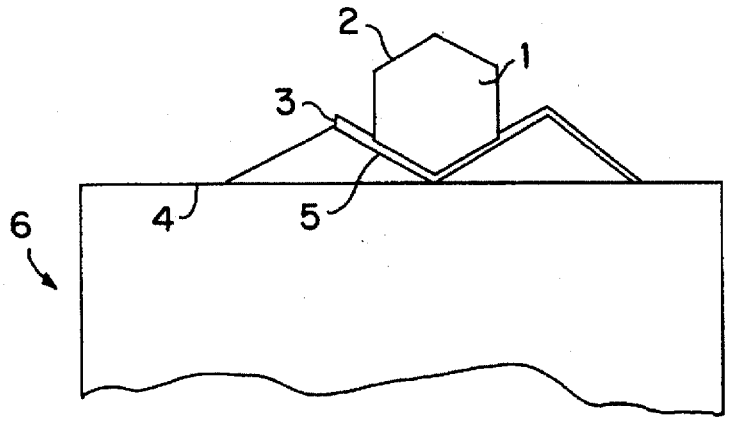
FIG. 2 is a cross-sectional view of a preferred embodiment of the invention, wherein the indentation in the surface texture has a 120° open angle, and the abrasive grain has an angle of incline of 30° relative to the plane of the cutting surface.

FIG. 2 illustrates the invention. The diamond grain (1) is oriented so as to expose a pointed edge formed by the diamond facets (2) which are parallel to the vertical sides of a microgroove (5) having a 120° open angle relative to the plane of the cutting surface (4) of the core (6). Thus, the vertical sidewalls of the microgroove shown in FIG. 2 each are positioned 30° from the plane of the cutting surface. Such a construction is preferred for providing the sharpest tool cutting surfaces.

Figure 3:
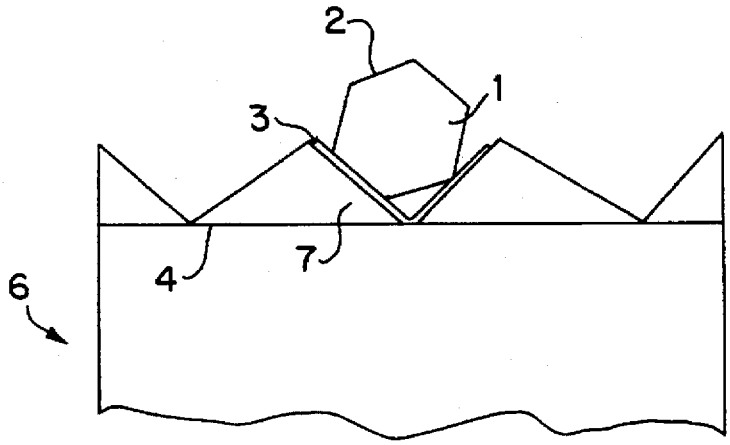
FIG. 3 is a cross-sectional view of an alternate configuration of the invention, wherein the indentation in the textured surface has a 90° open angle, and the abrasive grain has an angle of incline of 45° relative to the plane of the cutting surface.

Another embodiment of the invention is illustrated in FIG. 3. Unlike FIG. 2, the diamond grain (1) in FIG. 3 is contained in a microgroove (7) constructed with a 90° opening angle relative to the plane of the cutting surface. Due to the steepness of this angle, the diamond grain (1) is not fully seated in the microgroove (7). In contrast, the diamond grain shown in FIG. 2 is fully seated in the microgroove which has an opening angle of 120°.

The microgroove or other textured element of the cutting surface need not have a 120° angle opening to provide the sharpest tool, it must merely have an angle of opening which corresponds to the geometry of the superabrasive grain. Benefits of the invention will be observed in textured constructions having angle openings from 60° to 160°, preferably 90° to 120°, relative to the plane of the cutting surface of the tool. The width of the microgroove or indentation should be large enough to allow the grain to come to rest along one or both sides of the microgroove, or in direct contact with the periphery of the indentation. If the bottom of the indentation is flat, the width at the bottom should not be great enough to allow a flat face of the grain to come to rest at the bottom of the groove, thereby exposing a parallel flat face at the cutting surface of the grain.

Likewise, to optimize operation of the textured cutting surface, abrasive grain will be selected for uniform grades, both in terms of grain size and in grain morphology. Thus, well shaped grains such as those produced during synthetic diamond production or production of high grade cubic boron nitride are preferred for use herein. Preferred materials are produced under controlled growth conditions and graded or sorted, so that near-perfect crystals predominate and low grade, imperfect crystals are rare. This optimizes the effects of the hot metal braze during bonding and optimizes tool performance and tool life. To take advantage of the meniscus effect, superabrasive grains having opposing flat parallel faces are preferred for use herein.

The textured indentations may be formed by chemically etching or mechanically scoring, grinding, machining or stamping the cutting surface of the core. The pattern may be applied during casting, molding or finishing of the core, or by any means known in the art.

The depth of the indentations created in the cutting surface, as well as the density of the indentations may be selected by the practitioner to correspond with the size and shape of the diamond or other superabrasive and the particular purpose for which the cutting tool is designed. The dimensions of the textured surface must be selected so as to contain a single layer of superabrasive grain. The size of the indentations is less than, or equal to, the average size of the abrasive grains, with dimensions preferably 25 to 75% most preferably 25 to 50% less than those of the abrasive grain.

In a preferred embodiment, diamond abrasives of about 420 to 650 micron grain diameter (i.e., grades of abrasives containing a majority of 30/40 mesh diamond grit size) are bonded with a metal braze to a cutting surface which has been textured to contain parallel grooves with approximately 60° to 120° open angle and approximately 105 to 650 microns, preferably 105 to 315 microns, in maximum depth orthogonal to the plane of the cutting surface for each groove. For other abrasive grains, the preferred maximum depth of the textured indentations may be determined by the formula: $r/2 \leqq D \leqq 3r/2$, wherein r is the average radius of the smallest grains within the selected grade of abrasive and D is the maximum depth orthogonal to the plane of the cutting surface for the indentations.

Other embodiments suitable for use herein may be selected by the practitioner and include textured indentations designed to accommodate superabrasive grain of 25 to 1,000 microns in diameter (i.e., 325/400 to 20 mesh diamond grit size). Suitable indentations may have a maximum depth of 6 to 1,000 microns for these grit sizes.

The metal bond used to braze the diamond to the cutting surface may be selected from any metal bond known in the art. The core is preferably metal, but may comprise an assembly of structural materials other than metal, including but not limited to, ceramics, fiber-reinforced plastics and metal alloys, provided that the cutting surface is suitable for brazing a metal bond to the superabrasive grain.

The invention has broad applicability to all single layer abrasive cutting tools wherein the abrasive is adhered to the cutting tool by means of a brazed metal bond.

We claim:

1. An abrasive tool comprising:

a) a core having at least one cutting surface;

b) superabrasive grain having at least one flat surface; and c) a metal bond brazed to the cutting surface of the core and the superabrasive grain;

wherein the cutting surface of the core has indentations forming a texture, the indentations forming a texture being sized to contain a single layer of superabrasive grain oriented such that any flat surface of the superabrasive grain is inclined at an angle of at least 15° relative to the plane of the cutting surface.

2. The abrasive tool of claim 1, wherein a majority of the superabrasive grain consists of particles having at least one opposing set of flat surfaces.

3. The abrasive tool of claim 2, wherein the superabrasive grain is a diamond grit of 25 to 1,000 microns in diameter.

4. The abrasive tool of claim 2, wherein the superabrasive grain is selected from the group consisting of synthetic diamond and cubic boron nitride, and combinations thereof.

5. The abrasive tool of claim 1, wherein the core is steel.

6. The abrasive tool of claim 1, wherein the indentations forming a texture in the cutting surface of the core comprise a plurality of parallel microgrooves.

7. The abrasive tool of claim 1, wherein the indentations forming a texture in the cutting surface of the core comprise a plurality of radial microgrooves.

8. The abrasive tool of claim 1, wherein the indentations forming a texture in the cutting surface of the core comprise a plurality of cross-hatched microgrooves.

9. The abrasive tool of claim 1, wherein the indentations forming a texture in the cutting surface of the core comprise a plurality of spiral microgrooves.

10. The abrasive tool of claim 1, wherein the indentations forming a texture in the cutting surface of the core comprise an array of discreet indentations, each indentation having a depth no greater than an average dimension of a flat surface of the superabrasive grain.

11. The abrasive tool of claim 1, wherein the indentations forming a texture in the cutting surface define open angles, the open angles being substantially equal to an angle formed by a cutting point of the superabrasive grain.

12. The abrasive tool of claim 1, wherein the indentations forming a texture in the cutting surface define an open angle of 60° to 160°.

13. The abrasive tool of claim 1, wherein the indentations forming a texture in the cutting surface define an open angle of 90° to 120°.

14. The abrasive tool of claim 3, wherein the indentations forming a texture in the cutting surface of the metal core extend to a center depth of about 6 to 1,000 microns.

15. The abrasive tool of claim 3, wherein the indentations forming a texture in the cutting surface define an open angle of 90° to 120°.

* * * * *